US010595691B2

(12) United States Patent
Dimbylow et al.

(10) Patent No.: US 10,595,691 B2
(45) Date of Patent: Mar. 24, 2020

(54) VACUUM CLEANER

(71) Applicant: Dyson Technology Limited, Wiltshire (GB)

(72) Inventors: Stephen Robert Dimbylow, Swindon (GB); Robert Hinchliffe, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 113 days.

(21) Appl. No.: 15/760,916

(22) PCT Filed: Aug. 23, 2016

(86) PCT No.: PCT/GB2016/052612
§ 371 (c)(1),
(2) Date: Mar. 16, 2018

(87) PCT Pub. No.: WO2017/046560
PCT Pub. Date: Mar. 23, 2017

(65) Prior Publication Data

US 2018/0263439 A1 Sep. 20, 2018

(30) Foreign Application Priority Data

Sep. 17, 2015 (GB) ..... 1516500.4

(51) Int. Cl.
*A47L 5/24* (2006.01)
*A47L 9/00* (2006.01)
(Continued)

(52) U.S. Cl.
CPC ..... *A47L 5/24* (2013.01); *A47L 5/28* (2013.01); *A47L 9/00* (2013.01); *A47L 9/16* (2013.01); *A47L 9/2884* (2013.01)

(58) Field of Classification Search
CPC . A47L 5/24; A47L 9/2884; A47L 9/16; A47L 9/00; A47L 5/28; A47L 9/322
(Continued)

(56) References Cited

U.S. PATENT DOCUMENTS

| | | | | |
|---|---|---|---|---|
| 9,943,199 | B2 * | 4/2018 | Grey | A47L 5/24 |
| 2013/0160233 | A1 | 6/2013 | Peace et al. | |
| 2014/0137363 | A1 | 5/2014 | Wilson | |

FOREIGN PATENT DOCUMENTS

| | | |
|---|---|---|
| GB | 2 440 107 | 1/2008 |
| GB | 2 440 111 | 1/2008 |

(Continued)

OTHER PUBLICATIONS

Search Report dated Feb. 29, 2016, directed to GB Application No. 1516500.4; 1 page.

(Continued)

*Primary Examiner* — David Redding
(74) *Attorney, Agent, or Firm* — Morrison & Foerster LLP

(57) ABSTRACT

A handheld vacuum cleaner includes a cyclonic separating unit and a body that includes a suction generator, a battery and a handle by which the vacuum cleaner is supported during use. The handle is provided with an actuator in the form of a finger-operated trigger for actuating the vacuum cleaner and a trigger guard disposed below the trigger. The battery is disposed below the trigger guard such that the center of gravity of the vacuum cleaner is located below the trigger guard.

6 Claims, 8 Drawing Sheets

(51) Int. Cl.

| | |
|---|---|
| ***A47L 9/16*** | (2006.01) |
| ***A47L 5/28*** | (2006.01) |
| ***A47L 9/28*** | (2006.01) |

(58) Field of Classification Search
USPC ..... 15/344
See application file for complete search history.

(56) References Cited

FOREIGN PATENT DOCUMENTS

| | | |
|---|---|---|
| GB | 2468299 | 9/2010 |
| GB | 2484146 | 4/2012 |
| GB | 2497945 | 7/2013 |
| JP | 2002-85297 | 3/2002 |
| JP | 2014-100572 | 6/2014 |
| WO | WO-2014/195711 | 12/2014 |

OTHER PUBLICATIONS

International Search Report and Written Opinion dated Oct. 26, 2016, directed to International Application No. PCT/GB2016/052612; 10 pages.
Notice of Reasons for Rejection dated Apr. 22, 2019, directed to JP Application No. 2018-514345; 8 pages.
Notification of Reason for Refusal dated Jan. 21, 2019, directed to KR Application No. 10-2018-7007212; 9 pages.

* cited by examiner

VACUUM CLEANER

REFERENCE TO RELATED APPLICATIONS

This application is a national stage application under 35 USC 371 of International Application No. PCT/GB2016/052612, filed Aug. 23, 2016, which claims the priority of United Kingdom Application No. 1516500.4, filed Sep. 17, 2015, the entire contents of each of which are incorporated herein by reference.

FIELD OF THE INVENTION

This invention relates to a handheld vacuum cleaner.

BACKGROUND OF THE INVENTION

GB2440111B and GB2484146A disclose handheld vacuum cleaners comprising a main body having a handle and cyclonic separator arranged such that it extends alongside the handle. The handle is equipped with a spring-loaded trigger which is used to switch the vacuum cleaner on and off. A user holds the trigger pressed with a forefinger during cleaning tasks. Release of the trigger turns the vacuum cleaner off. The arrangement is particularly beneficial for battery-powered handheld vacuum cleaners because release of the trigger between cleaning tasks helps conserve battery energy.

However, when a user releases the trigger, the vacuum cleaner must be supported by the remaining four, typically weaker, fingers of the hand. Having to hold the handheld in this way for a prolonged period of time can cause fatigue.

SUMMARY OF THE INVENTION

According to some embodiments, there is provided a handheld vacuum cleaner comprising a cyclonic separating unit, and a body comprising a suction generator, a battery and a handle by which the vacuum cleaner is supported during use, the handle is provided with an actuator in the form of a finger-operated trigger for actuating the vacuum cleaner and a trigger guard disposed below the trigger, wherein the battery is disposed below the trigger guard such that the centre of gravity of the vacuum cleaner is located below the trigger guard.

According to some embodiments, a balanced arrangement is provided by which the vacuum cleaner can be support by the trigger guard when the trigger is released without tilting forward or rearward.

A lower surface of the battery may form a base of the vacuum cleaner, and the suction generator is arranged such that the centre of gravity of the vacuum cleaner is positioned above the base.

The cyclonic separating unit may extend forwardly of the trigger. The handle may be inclined with respect to the cyclonic separating unit to form an angle of not less than 85 degrees and not greater than 140 degrees, for example between 100 and 125 degrees, between the handle and the longitudinal axis of the cyclonic separating unit.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
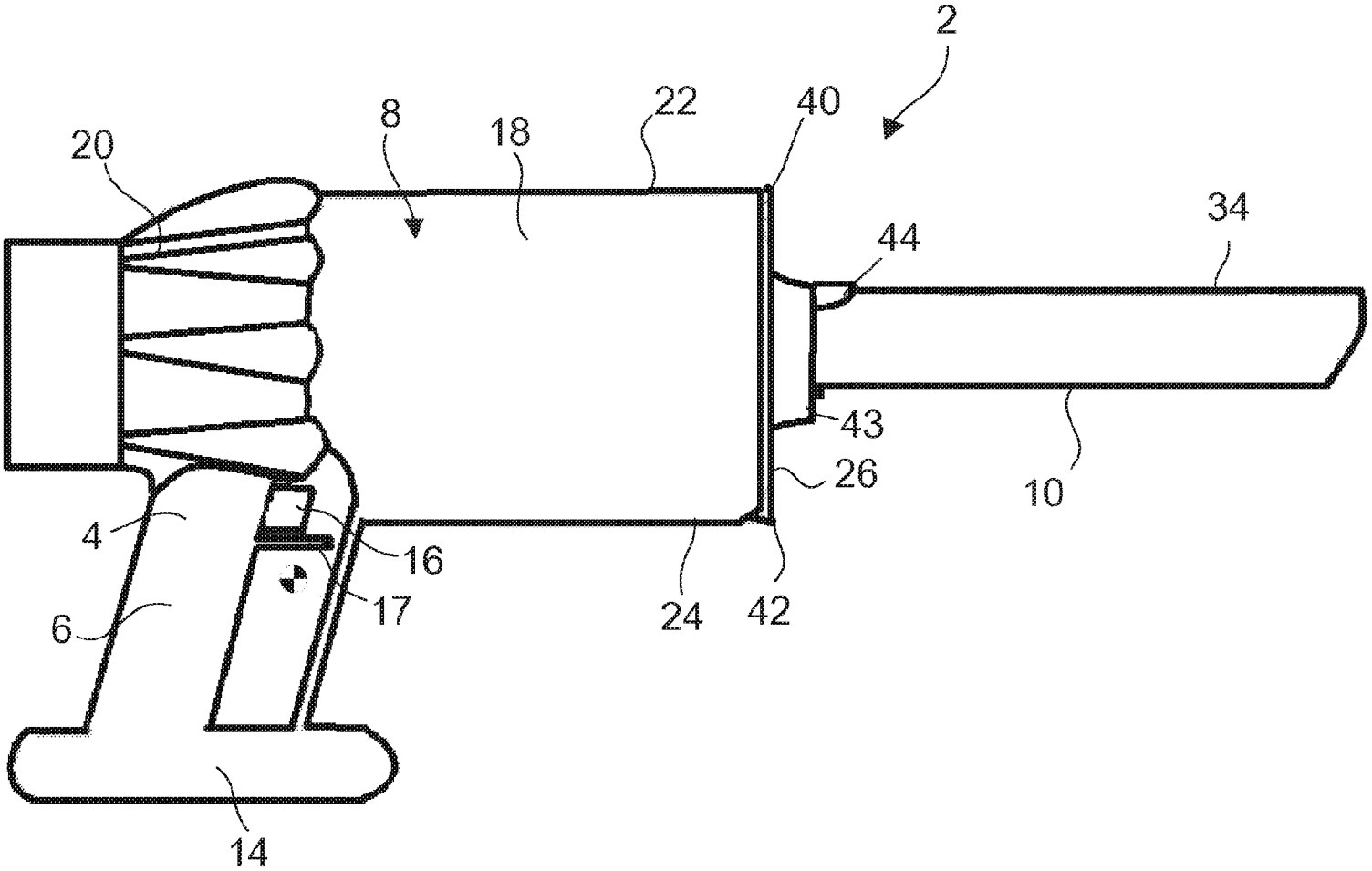
FIG. 1 is a profile view of a handheld vacuum cleaner.
Figure 2:
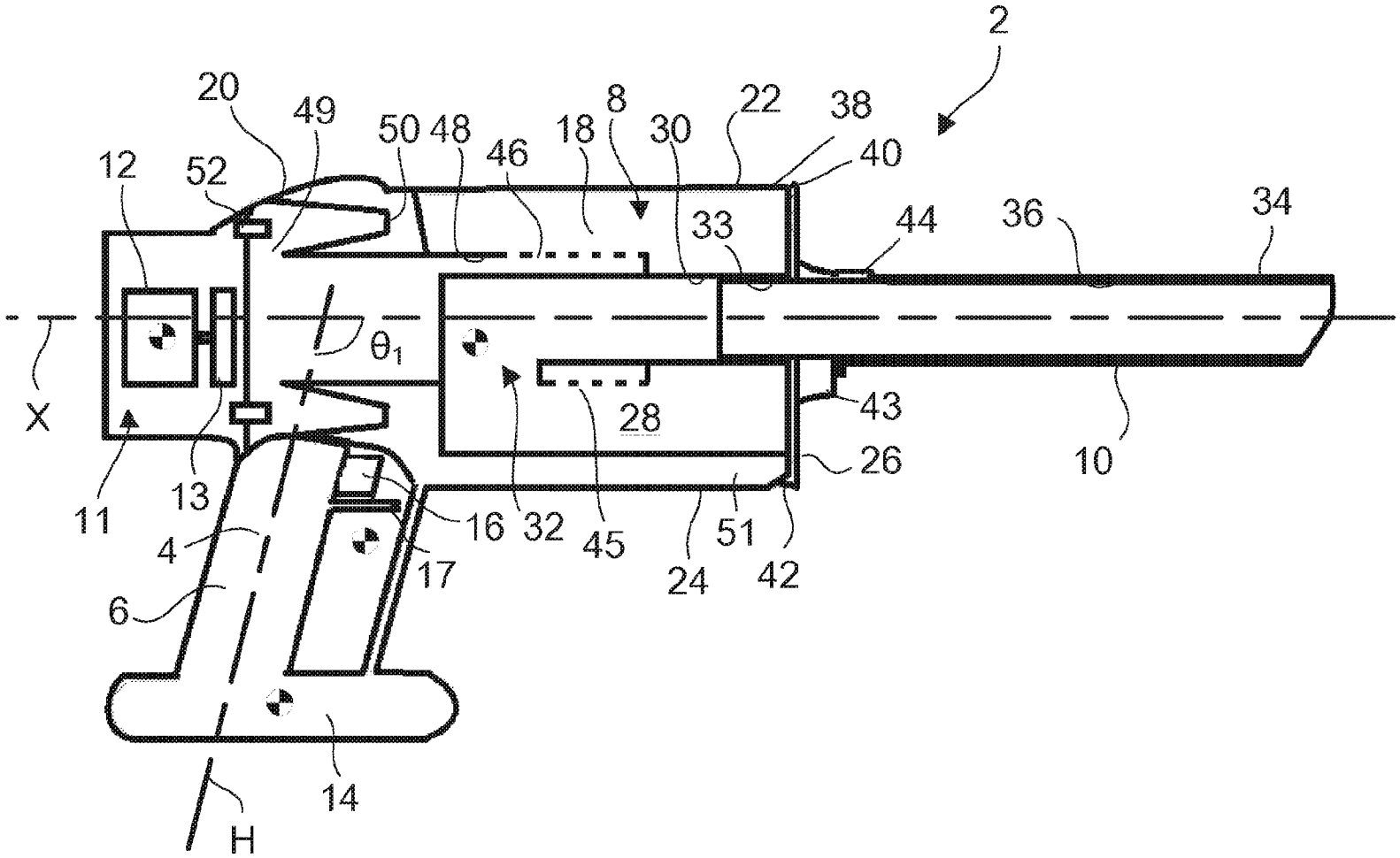
FIG. 2 is a profile sectional view of the handheld vacuum cleaner shown in FIG. 1.

FIGS. 1 and 2 show a handheld vacuum cleaner 2 comprising a main body 4 having an elongate handle 6, a cyclonic separating unit 8 having a longitudinal axis X and a cleaning tool 10, in the form of a nozzle, which is secured to the cyclonic separating unit 8. The cyclonic separating unit 8 extends away from the handle 6 such that the cleaning tool 10 is at the end of the cyclonic separating unit 8 which is furthest from the handle 6. The cleaning tool 10 extends away from the cyclonic separating unit 8 along the longitudinal axis X of the cyclonic separating unit 8.

The main body 4 further comprises a suction generator 11 comprising a motor 12 and impeller 13 which are located above and towards the rear of the handle 6, and a battery 14 located directly below the handle 6. An actuator in the form of a finger-operated trigger 16 is provided at an upper portion of the handle 6. A trigger guard 17 extends forwardly from the handle below the trigger 16. The handle 6 is arranged at an angle θ1 with respect to the longitudinal axis X of the cyclonic separating unit 8 such that the handle 6 is in a pistol grip configuration. In the embodiment shown, a handle axis H is arranged at 110 degrees with respect to the longitudinal axis X of the cyclonic separating unit 8. The angle $\theta_1$ is the included angle between the longitudinal axis X extending forward of the handle 6 and the portion of the handle axis H extending through the handle 6.

The cyclonic separating unit 8 comprises a primary cyclonic separator 18 and a plurality of secondary cyclonic separators 20 positioned downstream of the primary cyclonic separator 18. The primary cyclonic separator 18 is adjacent a first end of the cyclonic separating unit 8 and the secondary cyclonic separators 20 are adjacent a second end of the cyclonic separating unit 8 which is opposite the first end. The secondary cyclonic separators 20 are arranged in a circular array which extend about the longitudinal axis X of the cyclonic separating unit 8.

The primary cyclonic separator 18 comprises a separator body 22 in the form of a bin having a cylindrical outer wall 24 and an end wall 26. The cylindrical outer wall 24 defines a cyclonic separation chamber 28. In the embodiment shown, it is the axis of the cyclonic separation chamber 28 which defines the longitudinal axis X of the cyclonic separating unit 8. A central duct 30 extends from the end wall 26 to an inlet 32 of the cyclonic separation chamber 28.

The cleaning tool 10 comprises a connector portion 33 and a nozzle portion 34 which define a duct 36 along the cleaning tool 10. The connector portion 33 has an outer diameter which is smaller than the inner diameter of the portion of the central duct 30 adjacent the end wall 26 such that the connector portion 33 can be inserted into the central duct 30 (as illustrated) thereby ensuring a rigid connection between the cleaning tool 10 and the cyclonic separating unit 8.

The central duct 30 and the duct 36 through the cleaning tool 10 together define an inlet duct 30, 36 which extends coaxially with the longitudinal axis X and through the end of the cyclonic separating unit 8 which is furthest from the handle 6. The inlet 32 of the cyclonic separation chamber 28 is spaced away from the end wall 26 and is located towards the end of the primary cyclonic separator 18 which is opposite the end of the cyclonic separating unit 8 to which the cleaning tool 10 is connected. The cyclonic separation chamber 28 therefore surrounds the portion of the inlet duct formed by the central duct 30. A first portion of the central duct 30 leading from the end wall 26 extends along the axis X of the cyclonic separation chamber 28. A second portion of the central duct 30 extends from the first portion to the inlet 32 of the cyclonic separation chamber 28. The second portion extends in a direction which has both radial and circumferential components with respect to the cyclonic separation chamber 28 so as to promote rotational flow within the cyclonic separation chamber 28 during use.

The end wall 26 and the portion of the cylindrical outer wall 24 adjacent the end wall 26 define a dirt collector 38, which is in the form of a dirt collecting bin, in which dirt separated from the incoming flow by the primary cyclonic separator 18 is collected.

The end wall 26 is connected to the cylindrical outer wall 24 by a pivot 40 and is held in a closed position by a user-operable catch 42. The end wall 26 can be moved from the closed position, in which dirt is retained within the dirt collector 38, to an open position, in which dirt can be removed from the dirt collector 38, by releasing the catch 42 and pivoting the end wall 26 away from the end of the cylindrical outer wall 24. The cleaning tool 10 is provided with retaining features (not shown) which engage with the central duct 30 so as to secure the cleaning tool 10 to the central duct 30. The cleaning tool 10 further comprises an annular collar 43 that abuts the end wall 26 thereby holding the end wall 26 in the closed position, and so prevents accidental opening of the end wall 26 while the cleaning tool 10 is attached. The cleaning tool 10 has a manually operated catch 44 that is actuated in order to disengage the retaining features from the central duct 24 in order to remove the tool 10 from the cyclonic separating unit 8.

A cylindrical shroud 45 is disposed centrally within the cyclonic separation chamber 28 and extends coaxially with the axis of the chamber 28. Apertures 46 provided through the shroud 45 define a fluid outlet from the cyclonic separation chamber 28.

A duct 48, which is formed in part by the shroud 45, provides fluid communication between the outlet from the cyclonic separation chamber formed by the apertures 46 and inlets 49 of the secondary cyclonic separators 20. Each secondary cyclonic separator 20 has a solids outlet 50 at one end which is in communication with a fine dust collector 51 that extends along the side of the primary cyclonic separator 18. A fluid outlet 52 at the end of each of the secondary cyclonic separators 20 opposite the solids outlet 50.

The cyclonic separating unit 8, suction generator 11 and battery 14 are expected to be the heaviest components of the vacuum cleaner 2. The separator 8 has a centre of gravity which is forward of the trigger guard 17 and so generates a clockwise moment about the trigger 16 and the trigger guard 17 (as viewed in FIG. 2). The battery 14 has a centre of gravity which is rearward of the trigger guard 17. The battery 14 therefore exerts an anticlockwise moment about the trigger 16 and the trigger guard 17. The suction generator 11 also has a centre of gravity which is rearward of the trigger guard 17. The cyclonic separating unit 8, suction generator 11 and battery 14 are positioned such that the net moment of all of the components of the vacuum cleaner 2 about an axis that extends perpendicularly with respect to the handle 6 and the longitudinal axis X of the cyclonic separating unit 8 and which passes through a region immediately below the trigger guard 17 is zero. The centre of gravity of the vacuum cleaner 2 is therefore located within the region below the trigger guard 17 such that when the trigger 16 is released by a user, the handheld vacuum cleaner 2 is balanced about a point below the trigger guard 17 and so can be supported easily by the rest of the user's fingers on the handle 6 and the upper finger against the trigger guard 17 without tipping forwards or backwards. Furthermore, the vacuum cleaner 2 can be supported on the battery 14, which forms a base of the vacuum cleaner 2, without toppling over.

Figure 3:
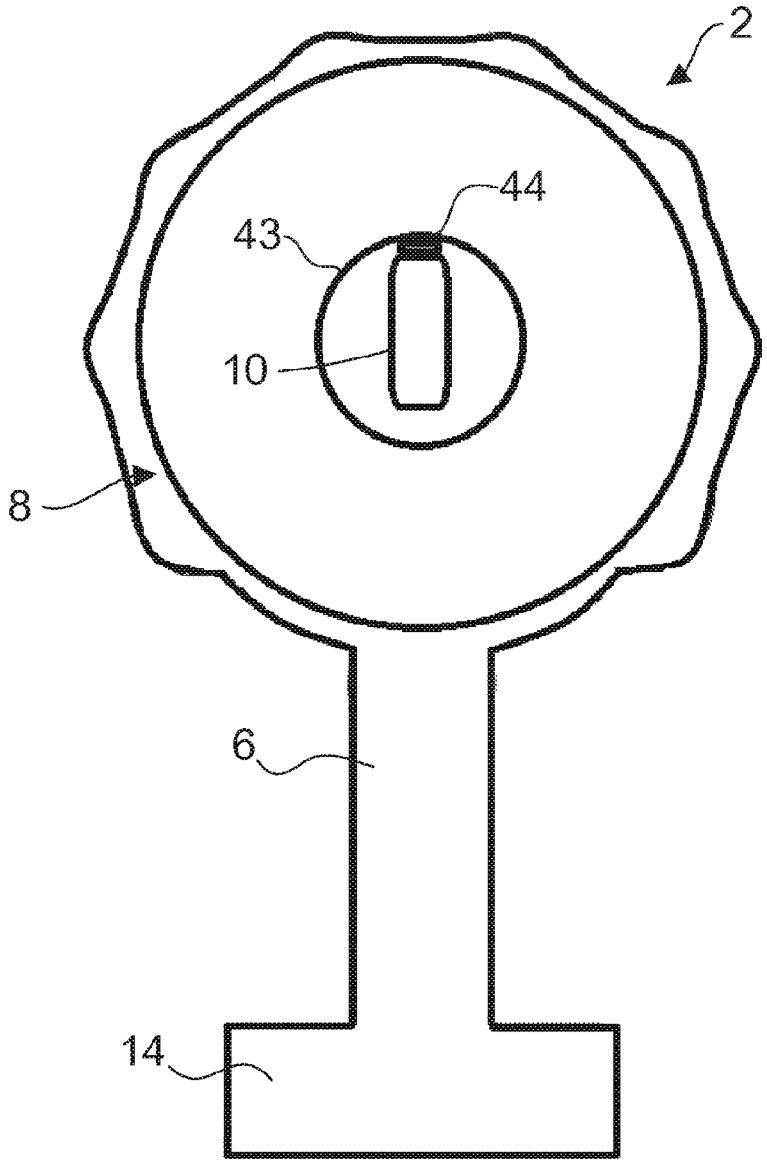
FIG. 3 is a front view of the handheld vacuum cleaner shown in FIG. 1.

FIG. 3 shows the vacuum cleaner 2 from the front. The cleaning tool 10 is relatively straight and slender and extends along the longitudinal axis X. The cleaning tool 10 therefore extends within the outer profile of the cyclonic separating unit 8 as viewed from the front of the vacuum cleaner 2 along the longitudinal axis X.

In use, the handheld vacuum cleaner 2 is activated by a user pressing the trigger 16 with an index finger. Dirty air is drawn by the suction generator 11 through the inlet duct 30, 36 and through the inlet 32 into the cyclonic separation chamber 28. The rotational flow promoted by the second portion of the central duct 30 within the cyclonic separation chamber 28 produces a cyclonic action that separates relatively heavy or large dirt from the air. Typically, the vacuum cleaner 2 is held such that the cyclonic separating unit 8 points downwardly from the handle 6. Dirt separated in the cyclonic separation chamber 28 therefore falls under the influence of gravity into the dirt collector 38. The partially cleaned air passes through the apertures 46 in the shroud 45 and is drawn along the duct 48 to the secondary cyclones 20. Smaller and lighter particles of dirt are separated from the air by the secondary cyclones 20 and expelled through the respective solids outlets into the fine dust collector 51. The cleaned air exits the secondary cyclones 20 via the respective fluid outlets 52 of the secondary cyclones 20 through the suction generator 11 and out of vents (not shown) at the rear of the main body 4.

Figure 4:
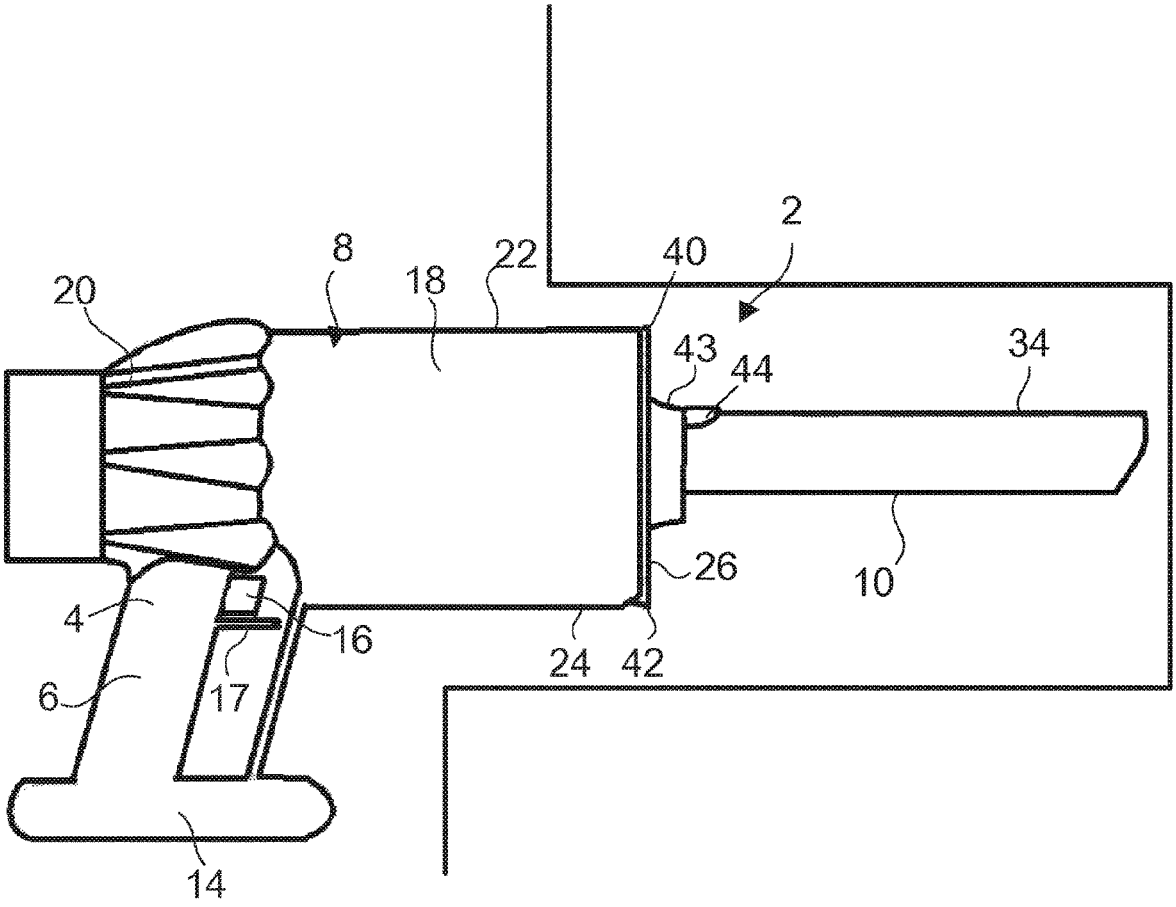
FIG. 4 shows the handheld vacuum cleaner shown in FIG. 1, in use.
Figure 5C:
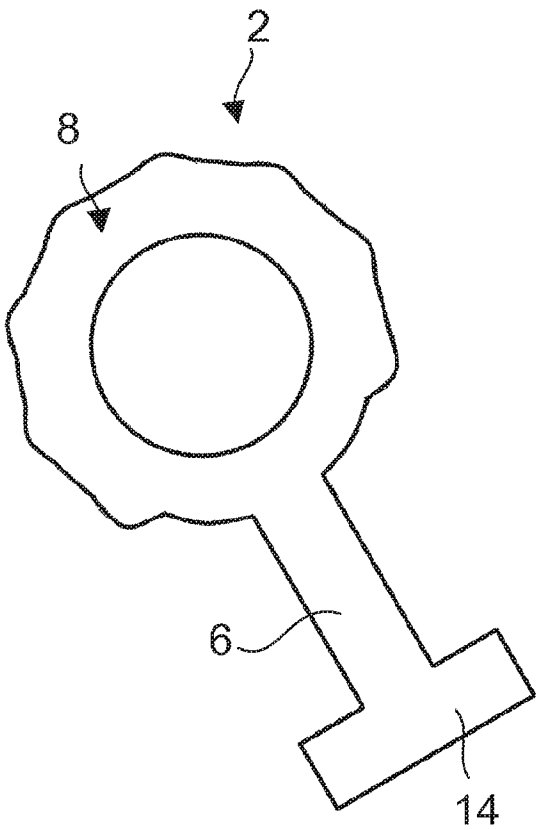
FIGS. 5*a*, 5*b* and 5*c* are representations of the handheld vacuum cleaner shown in FIG. 1 in different orientations.
Figure 5B:
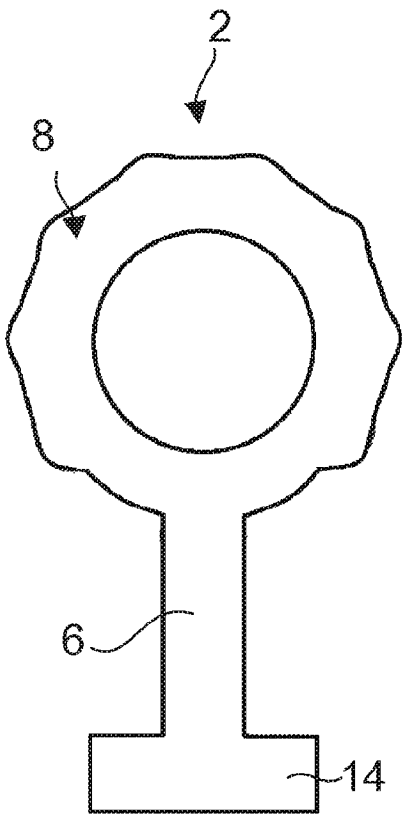
Figure 5A:
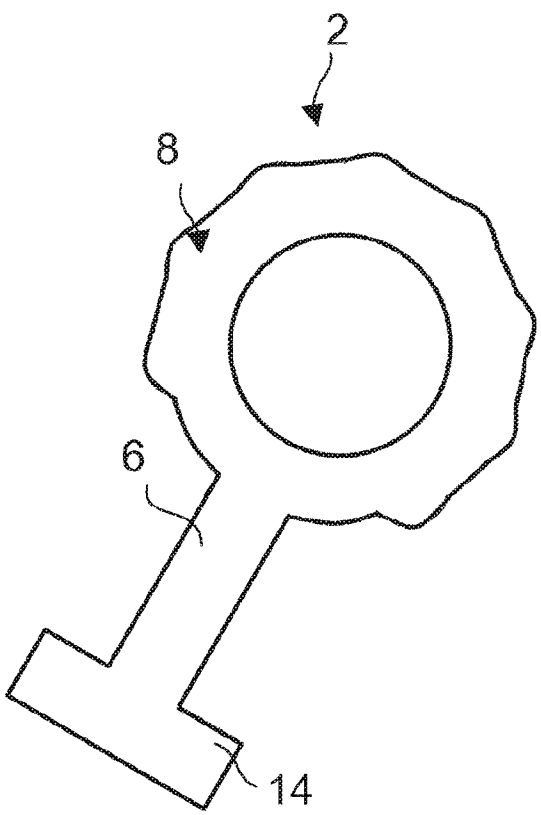

The alignment of the axis X of the cyclonic separating unit 8 with the cleaning tool 10 makes the vacuum cleaner 2 compact and enables the end of the cyclonic separating unit 8 to be inserted into confined spaces during cleaning, as illustrated in FIG. 4. The vacuum cleaner 2 is therefore particularly suitable for cleaning places that are difficult to reach, such as gaps between items of furniture, walls and appliances. Furthermore, the cyclonic separating unit 8 can be rotated substantially within its own profile during cleaning. That is, the area swept by the cyclonic separating unit 8 (as viewed along the longitudinal axis X) as the cyclonic separating unit 8 is rotated about its longitudinal axis X, is not significantly greater than the actual area occupied by the cyclonic separating unit 8. A schematic illustration of the vacuum cleaner 2 with the handle in a vertical orientation is shown in FIG. 5*b*. FIGS. 5*a* and 5*c* show the vacuum cleaner 2 rotated through 45 degrees away from the orientation shown in FIG. 5*b* in each direction. The cyclonic separating unit 8 can therefore be rotated clockwise and anticlockwise within the confined space without colliding with surfaces of the confined space, and so can be manipulated easily in order to clean hard-to-reach surfaces.

Figure 6:
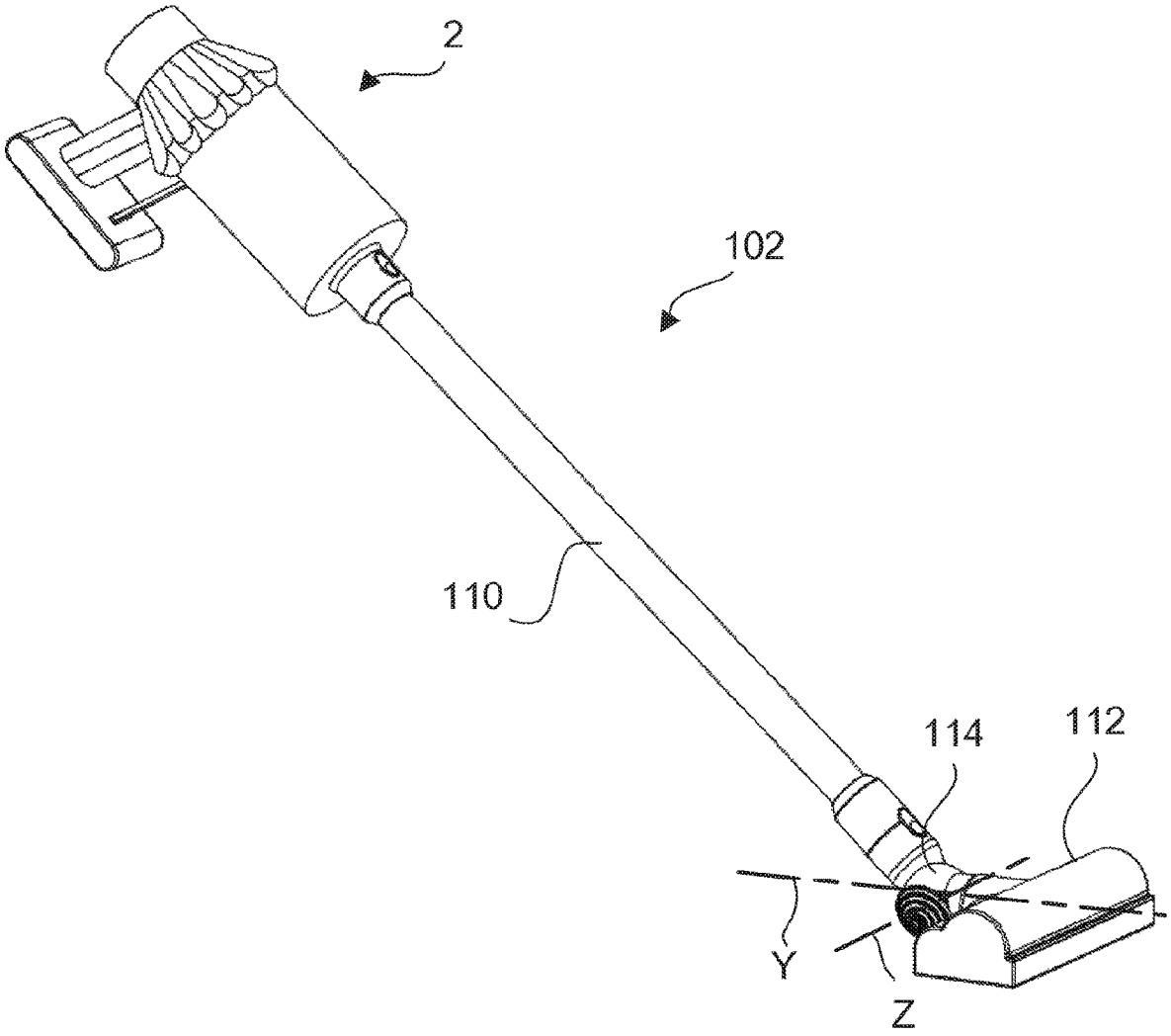
FIG. 6 is a perspective view of a stick vacuum cleaner comprising the handheld vacuum cleaner shown in FIG. 1.

In addition to the above benefits, the alignment of the cleaning tool 10 with the longitudinal axis X ensures that the inclination angle of the cyclonic separating unit 8 does not vary as the vacuum cleaner 2 is rotated about the longitudinal axis X and so the separation of efficiencies of the primary cyclonic separator 18 and the secondary cyclonic separators 20 remain approximately constant during use. This is particularly advantageous when the cleaning tool 10 is replaced with a wand 110 and a cleaner head 112 to form a stick vacuum cleaner 102, as shown in FIG. 6.

Figures 7A, 7B, 7C:
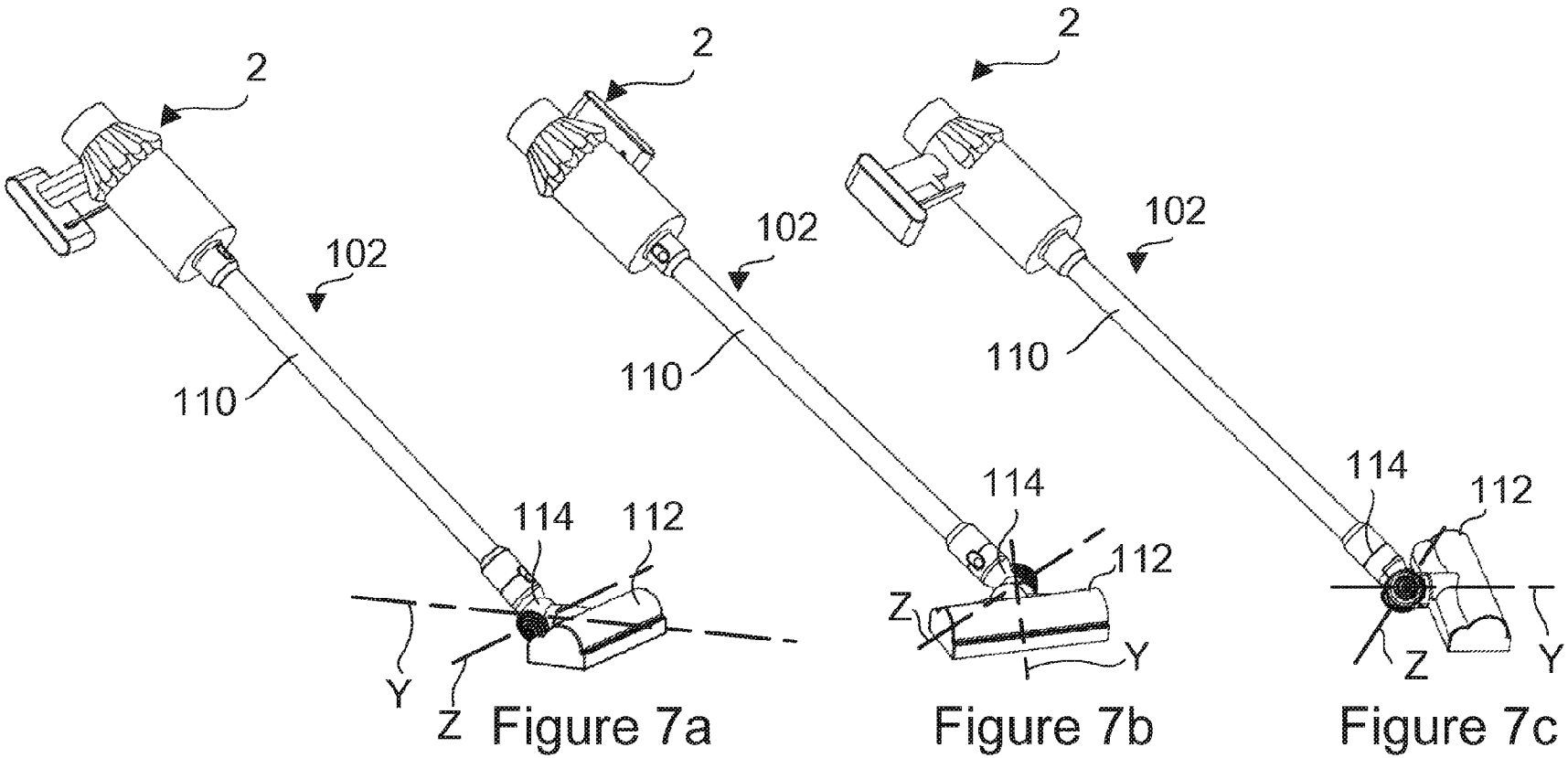
FIGS. 7*a*, 7*b* and 7*c* are show different orientations of the vacuum cleaner shown in FIG. 6.

The wand 110 extends coaxially with the longitudinal axis X of the cyclonic separating unit 8. The cleaner head 112 comprises an articulated neck 114 having first and second rotational axes Y, Z that are arranged perpendicular to each other. The arrangement of the axes Y, Z is such that, when the cleaner head 112 is placed on a surface with the wand 110 inclined with respect to the surface, rotation of the stick vacuum cleaner 102 about the longitudinal axis X of the cyclonic separating unit 8 (and hence rotation of the wand 110 about the wand axis) causes the cleaner head 112 to steer left or right, as shown in FIGS. 7*a* to 7*c*.

As mentioned above, the inclination of the longitudinal axis X of the cyclonic separating unit 8 remains substantially constant as the cleaner head 114 is steered across a surface being cleaned. Consequently, unlike known stick vacuum cleaners, the cyclonic separation efficiency remains substantially constant and the risk of re-entrainment remains low.

A further benefit is that the centre of gravity of the cyclonic separating unit 8 is located at or close to the axis of the wand 110. Consequently, the weight balance of the cyclonic separating unit 8 about the axis of the wand 110 remains approximately constant as the cyclonic separating unit 8 is rotated during cleaning. The vacuum cleaner 2 is therefore easy to manoeuvre.

Figure 8:
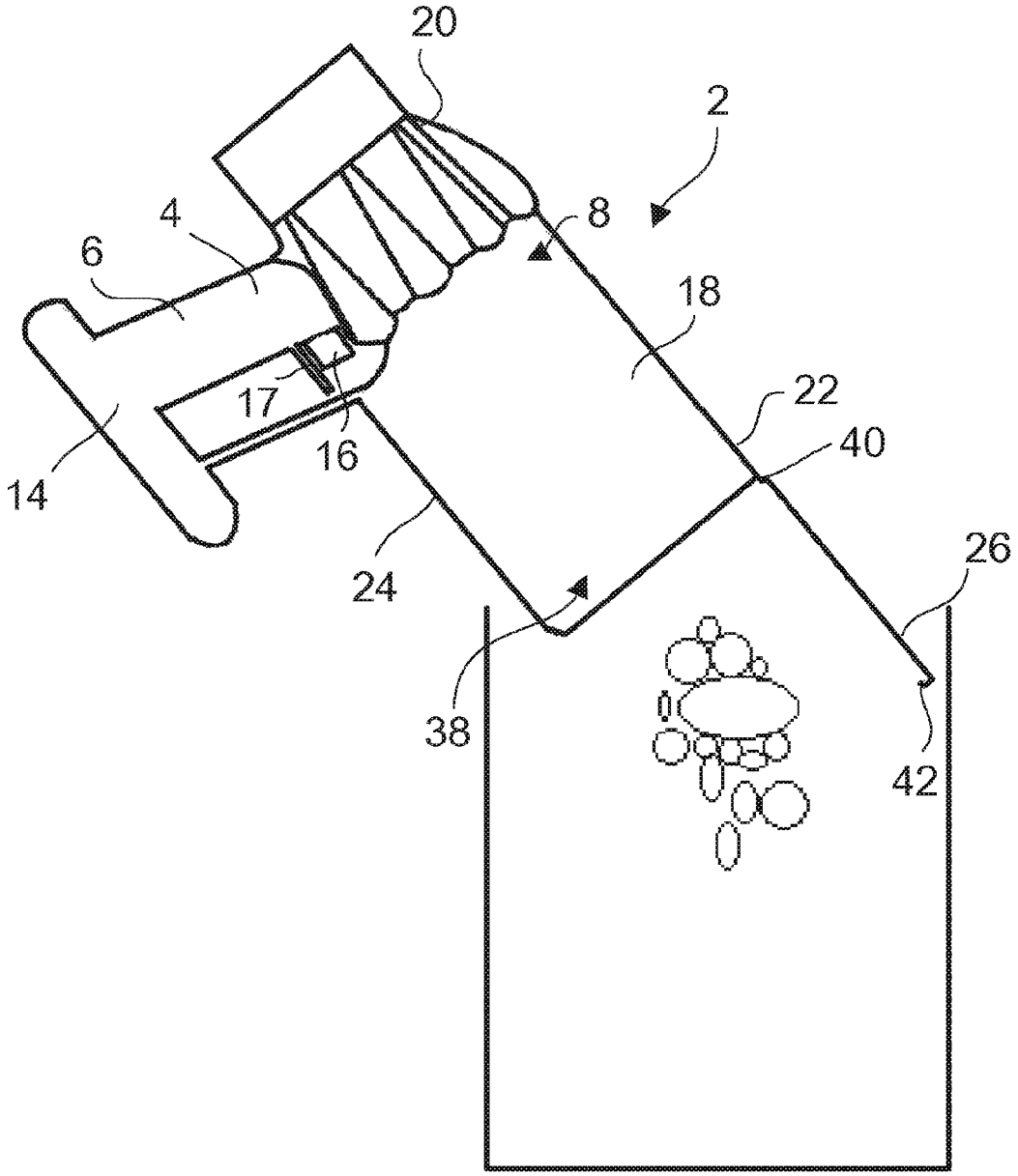
FIG. 8 shows the vacuum cleaner shown in FIG. 1 being emptied.

Referring to FIG. 8, in order to empty the dirt collector 38 and the fine dust collector 51 of either of the described embodiments, the user first disconnects the cleaning tool 10 or the wand 110. Then, whilst gripping the handle 6, the user points the vacuum cleaner 2 towards a suitable receptacle (e.g. a waste bin or bag) into which the dirt is to be emptied. The catch 42 is then released by the user and the end wall 26 pivoted from its closed position into its open position. Since the cyclonic separating unit 8 is pointed away from the user, there is no need for the user to adopt a different grip or posture from that which is adopted during normal cleaning. Consequently, the process by which the dirt collector 38 and the fine duct collector 51 are emptied is very intuitive and ergonomic. Furthermore, dirt exits the dirt collector 38/fine dust collector 51 from the end of the cyclonic separating unit 8 which is furthest from the handle 6. Therefore, there is less risk that dirt will spill from the dirt collector 38/fine dust collector 51 onto a user during emptying.

In an alternative arrangement, the inlet duct may be spaced from the axis of the cyclonic separating unit 8. Nevertheless, the cyclonic separating unit may be arranged to extend partly around a portion of the inlet duct or to entirely surround a portion of the inlet duct. For example, the inlet duct may be recessed into the side of the cyclonic separating unit such that duct extends within the profile of the cyclonic separating unit when viewed along the axis of the cyclonic separating unit.

The invention claimed is:

1. A handheld vacuum cleaner comprising:

a cyclonic separating unit; and a body comprising a suction generator, a battery, and a handle by which the vacuum cleaner is supported during use, the handle is provided with an actuator in the form of a finger-operated trigger for actuating the vacuum cleaner and a trigger guard disposed below the trigger, wherein the battery is disposed below the trigger guard such that the center of gravity of the vacuum cleaner is located below the trigger guard, and wherein the suction generator and the cyclonic separating unit are located at a first end of the handle and the battery is located at a second end of the handle that is opposite the first end.

2. The handheld vacuum cleaner of claim 1, wherein a lower surface of the battery forms a base of the vacuum cleaner, and the suction generator is arranged such that the center of gravity of the vacuum cleaner is positioned above the base.

3. The handheld vacuum cleaner of claim 1, wherein the cyclonic separating unit extends forwardly of the trigger.

4. The handheld vacuum cleaner of claim 1, wherein the handle is inclined with respect to the cyclonic separating unit to form an angle of not less than 85 degrees and not greater than 140 degrees between the handle and a longitudinal axis of the cyclonic separating unit.

5. The handheld vacuum cleaner of claim 1, wherein the cyclonic separating unit has a longitudinal axis and the longitudinal axis is above the handle.

6. The handheld vacuum cleaner of claim 1, wherein cyclonic separating unit comprises an air inlet and the longitudinal axis extends through the air inlet.

* * * * *